US011213122B1

(12) United States Patent
Hernandez

(10) Patent No.: US 11,213,122 B1
(45) Date of Patent: Jan. 4, 2022

(54) STORAGE CABINET ASSEMBLY

(71) Applicant: Eduardo Z Hernandez, Camarillo, CA (US)

(72) Inventor: Eduardo Z Hernandez, Camarillo, CA (US)

( * ) Notice: Subject to any disclaimer, the term of this patent is extended or adjusted under 35 U.S.C. 154(b) by 0 days.

(21) Appl. No.: 16/942,378

(22) Filed: Jul. 29, 2020

(51) Int. Cl.

| | |
|---|---|
| ***A47B 69/00*** | (2006.01) |
| ***A47B 96/02*** | (2006.01) |
| ***A47B 81/04*** | (2006.01) |
| ***F25D 11/00*** | (2006.01) |
| ***A47B 96/04*** | (2006.01) |

(52) U.S. Cl.
CPC ..... *A47B 69/00* (2013.01); *A47B 81/04* (2013.01); *A47B 96/025* (2013.01); *A47B 96/04* (2013.01); *F25D 11/00* (2013.01); *A47B 2220/0077* (2013.01)

(58) Field of Classification Search
CPC ..... A47B 69/00; A47B 81/04; A47B 96/025; A47B 96/04; F25D 11/00
USPC ..... 312/100, 107
See application file for complete search history.

(56) References Cited

U.S. PATENT DOCUMENTS

| | | | | | |
|---|---|---|---|---|---|
| 3,715 | A * | 11/1869 | Fitzgibbons | | |
| 422,098 | A * | 2/1890 | Tetamore | | |
| 1,919,898 | A | 7/1933 | Martin | | |
| 3,672,741 | A * | 6/1972 | Clark | A47B 49/00 | 312/7.2 |
| 3,915,529 | A | 10/1975 | Bernier | | |
| 3,983,583 | A * | 10/1976 | Herman | A47B 69/00 | 62/331 |
| 5,020,867 | A * | 6/1991 | McManus | A47B 46/00 | 312/140.2 |
| 6,022,088 | A * | 2/2000 | Metzler | G16H 40/63 | 312/209 |
| 6,543,436 | B2 | 4/2003 | Montgomery | | |
| 6,836,910 | B2 | 1/2005 | Cawthon | | |
| 7,828,398 | B1 * | 11/2010 | Burnick | A47F 9/005 | 312/140.2 |
| 8,147,009 | B1 | 4/2012 | Rider | | |
| 8,522,768 | B2 | 9/2013 | Zelek | | |
| D769,668 | S | 10/2016 | Lally | | |
| 2001/0030492 | A1 * | 10/2001 | Branz | F25D 23/02 | 312/236 |

(Continued)

FOREIGN PATENT DOCUMENTS

| | | |
|---|---|---|
| WO | WO2006041603 | 4/2006 |

*Primary Examiner* — James O Hansen

(57) ABSTRACT

A storage cabinet assembly for outdoor storage of wine and related accessories includes a housing having a plurality of divider panels engaged thereto in an interior space thereof defining a plurality of compartments. The plurality of compartments comprises first, second, and third compartments. The first compartment is configured to position one of a refrigerator and a wine rack. The second compartment has a plurality of upper slats positioned therein to define a plurality of slots, which allow for insertion of bases of stemware to stow stemware within the second compartment. The third compartment opens into the second compartment and is used to stow utensils. The housing has positioned therein a first and second openings to allow access to the first and second compartments, respectively. A first door and a second door are hingedly engaged to the housing and are configured to selectively close the first and second openings, respectively.

19 Claims, 8 Drawing Sheets

(56) References Cited

U.S. PATENT DOCUMENTS

| | | | | |
|---|---|---|---|---|
| 2004/0140744 | A1* | 7/2004 | Kalieta | A47B 69/00 312/326 |
| 2005/0103321 | A1 | 5/2005 | Wishart | |
| 2008/0012454 | A1* | 1/2008 | Kim | A47B 87/0292 312/107 |
| 2010/0123374 | A1* | 5/2010 | Tsung | A47J 37/0786 312/100 |
| 2011/0084576 | A1* | 4/2011 | Leatherman | A47B 47/045 312/100 |
| 2011/0300272 | A1* | 12/2011 | Smario | F25D 23/12 426/243 |
| 2013/0113343 | A1 | 5/2013 | Singlak | |
| 2015/0027350 | A1 | 1/2015 | Castillo | |

* cited by examiner

STORAGE CABINET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage cabinets and more particularly pertains to a new storage cabinet for outdoor storage of wine and related accessories.

(2) Description of Related Art Including Information Disclosed Under 37 CFR 1.97 and 1.98

The prior art relates to storage cabinets but does not disclose storage cabinets intended for outdoor storage of wine and related accessories nor the base features of the present invention.

BRIEF SUMMARY OF THE INVENTION

An embodiment of the disclosure meets the needs presented above by generally comprising a housing having a plurality of divider panels engaged thereto in an interior space thereof defining a plurality of compartments. The plurality of compartments comprises first, second, and third compartments. The first compartment is configured to position one of a refrigerator and a wine rack. The second compartment is positioned above the first compartment and has a plurality of upper slats positioned therein, which are engaged to an upper limit of the second compartment to define a plurality of slots. The slots are configured for insertion of bases of stemware to stow stemware within the second compartment. The third compartment opens into the second compartment and is configured to stow utensils.

The housing has positioned therein a first opening and a second opening to allow access to the first compartment and the second compartment, respectively. A first door and a second door are hingedly engaged to the housing and are configured to selectively close the first opening and the second opening, respectively.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
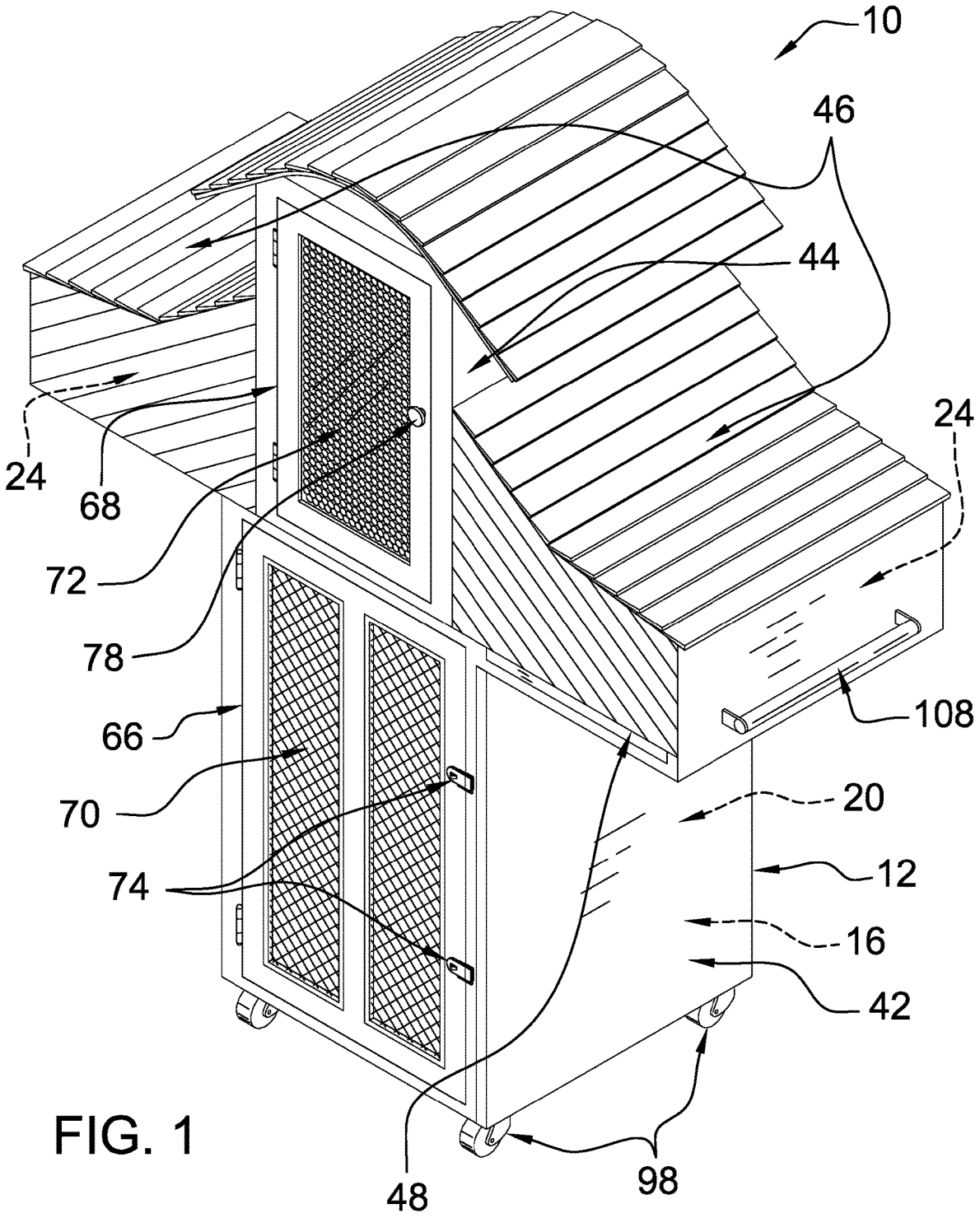
FIG. 1 is an isometric perspective view of a storage cabinet assembly according to an embodiment of the disclosure.

With reference now to the drawings, and in particular to FIGS. 1 through 9 thereof, a new storage cabinet embodying the principles and concepts of an embodiment of the disclosure and generally designated by the reference numeral 10 will be described.

As best illustrated in FIGS. 1 through 9, the storage cabinet assembly 10 generally comprises a housing 12 having a plurality of divider panels 14 engaged thereto in an interior space 16 thereof defining a plurality of compartments 18. The plurality of compartments 18 comprises a first compartment 20, a second compartment 22, and a third compartment 24.

Figure 9:
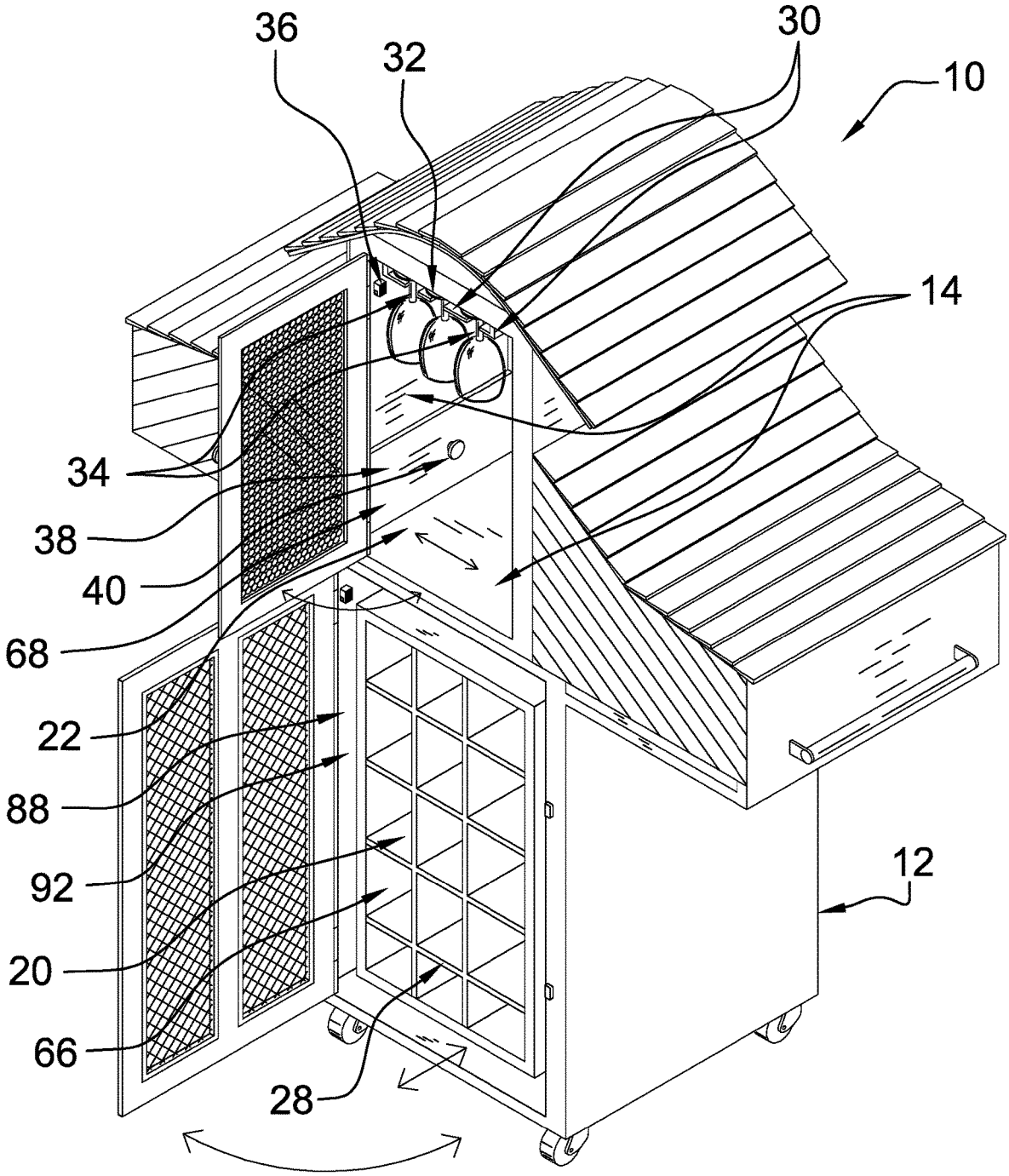
FIG. 9 is an in-use view of an embodiment of the disclosure.

The first compartment 20 is configured to position one of a refrigerator 26, as shown in FIG. 1, and a wine rack 28, as shown in FIG. 9. The second compartment 22 is positioned above the first compartment 20 and has a plurality of upper slats 30 positioned therein, which are engaged to an upper limit 32 of the second compartment 22 to define a plurality of slots 34. The slots 34 are configured for insertion of bases of stemware to stow stemware within the second compartment 22. A light 36 is engaged to one of the housing 12 and a respective divider panel 14. The light 36 is positioned in and configured to selectively illuminate the second compartment 22.

The third compartment 24 opens into the second compartment 22 and is configured to stow utensils. A drawer 38 is positioned in and is selectively slidable from the third compartment 24 into the second compartment 22. The drawer 38 is configured to stow utensils. The utensils are accessible to the user when the drawer 38 is pulled from the third compartment 24 into the second compartment 22. A drawer knob 40 is engaged to the drawer 38 and is configured to be grasped in the hand of the user to draw the drawer 38 into the third compartment 24. The third compartment 24 may be one of a pair of third compartments 24, which bracket the second compartment 22.

The housing 12 comprises a first section 42, a second section 44, and a pair of third sections 46, which contain the first compartment 20, the second compartment 22, and the third compartments 24, respectively. The first section 42 and the second section 44 are substantially rectangularly box shaped. The second section 44 is engaged to and is positioned above the first section 42. The third sections 46 bracket the second section 44.

Figure 2:
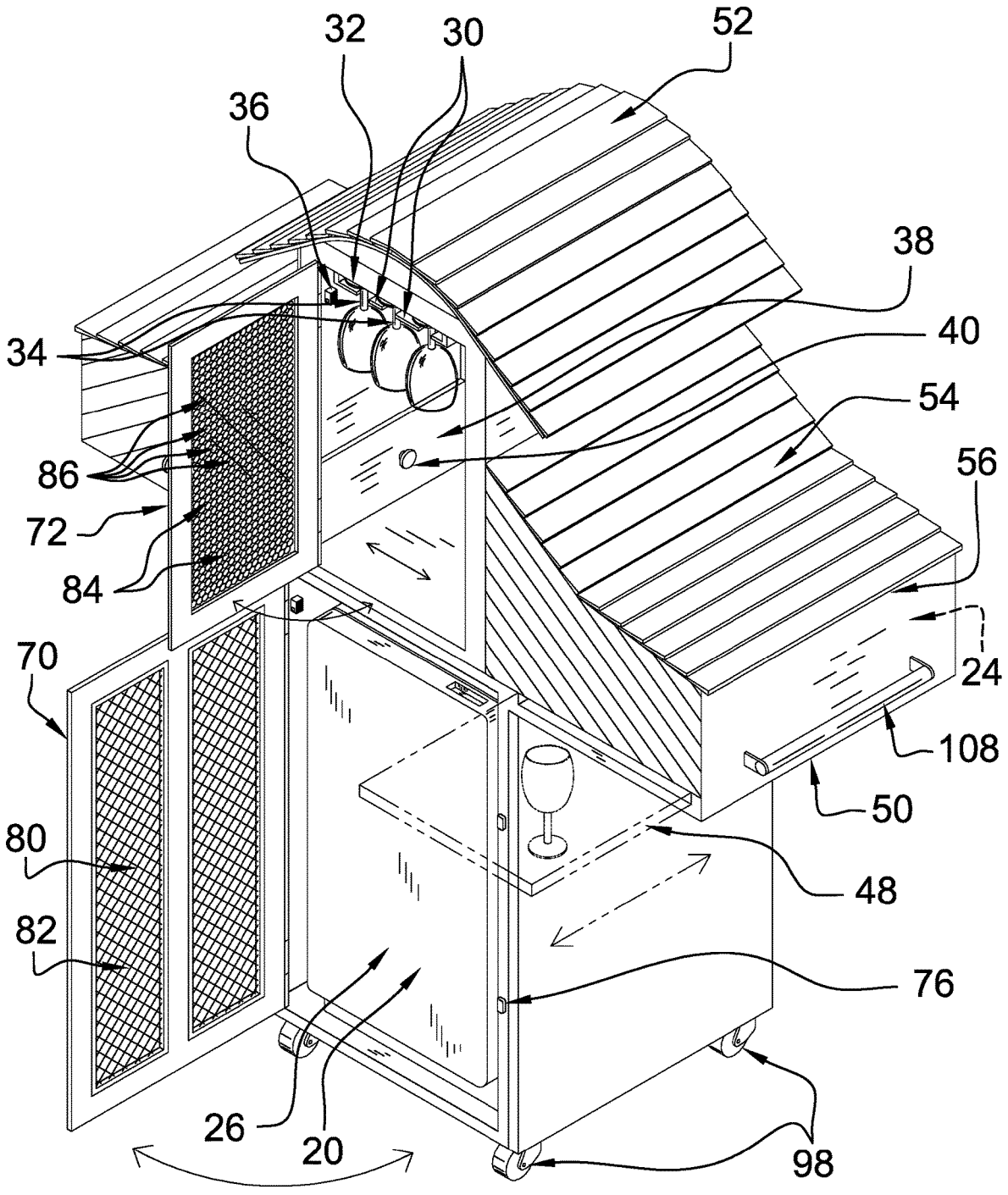
FIG. 2 is an in-use view of an embodiment of the disclosure.
Figure 3:
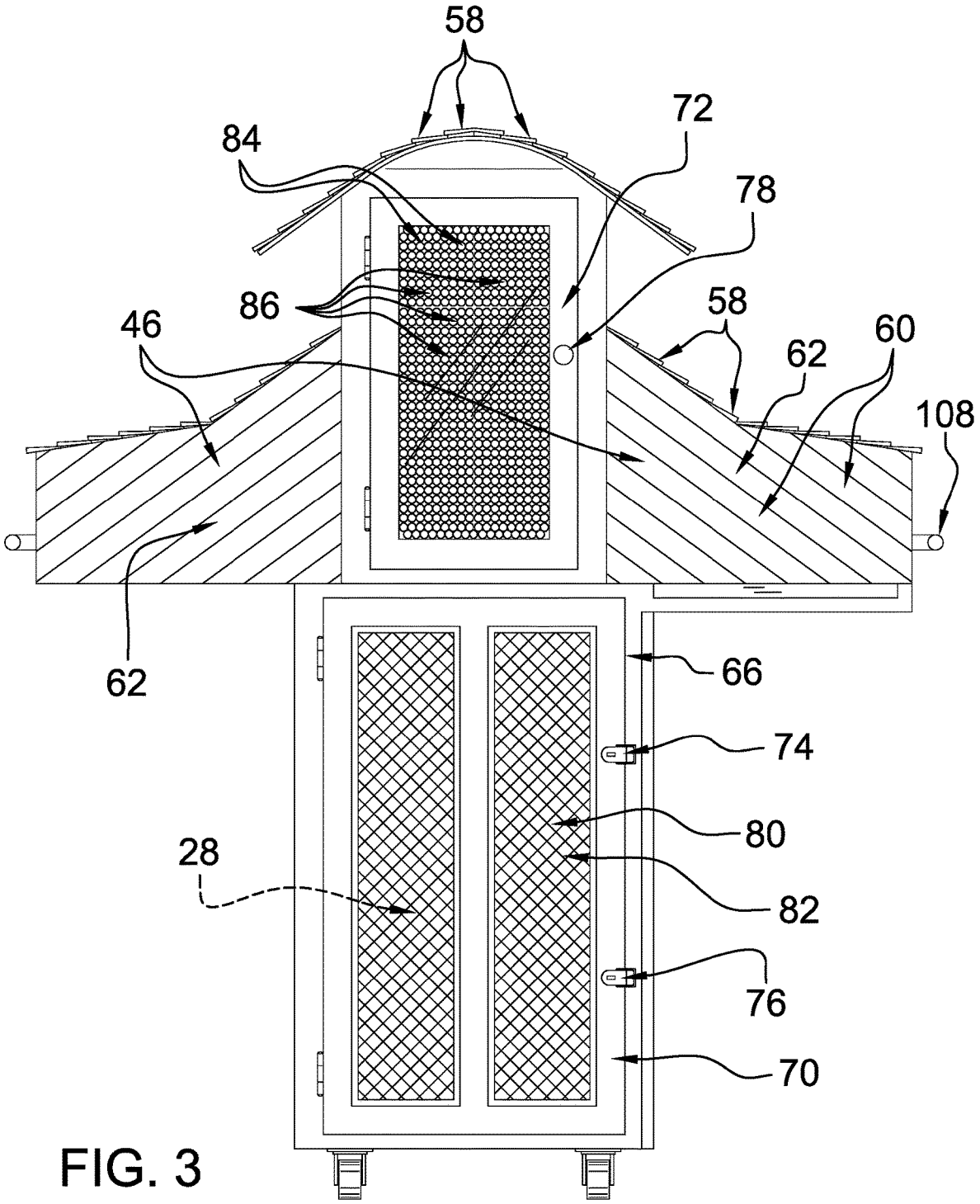
FIG. 3 is a front view of an embodiment of the disclosure.
Figure 4:
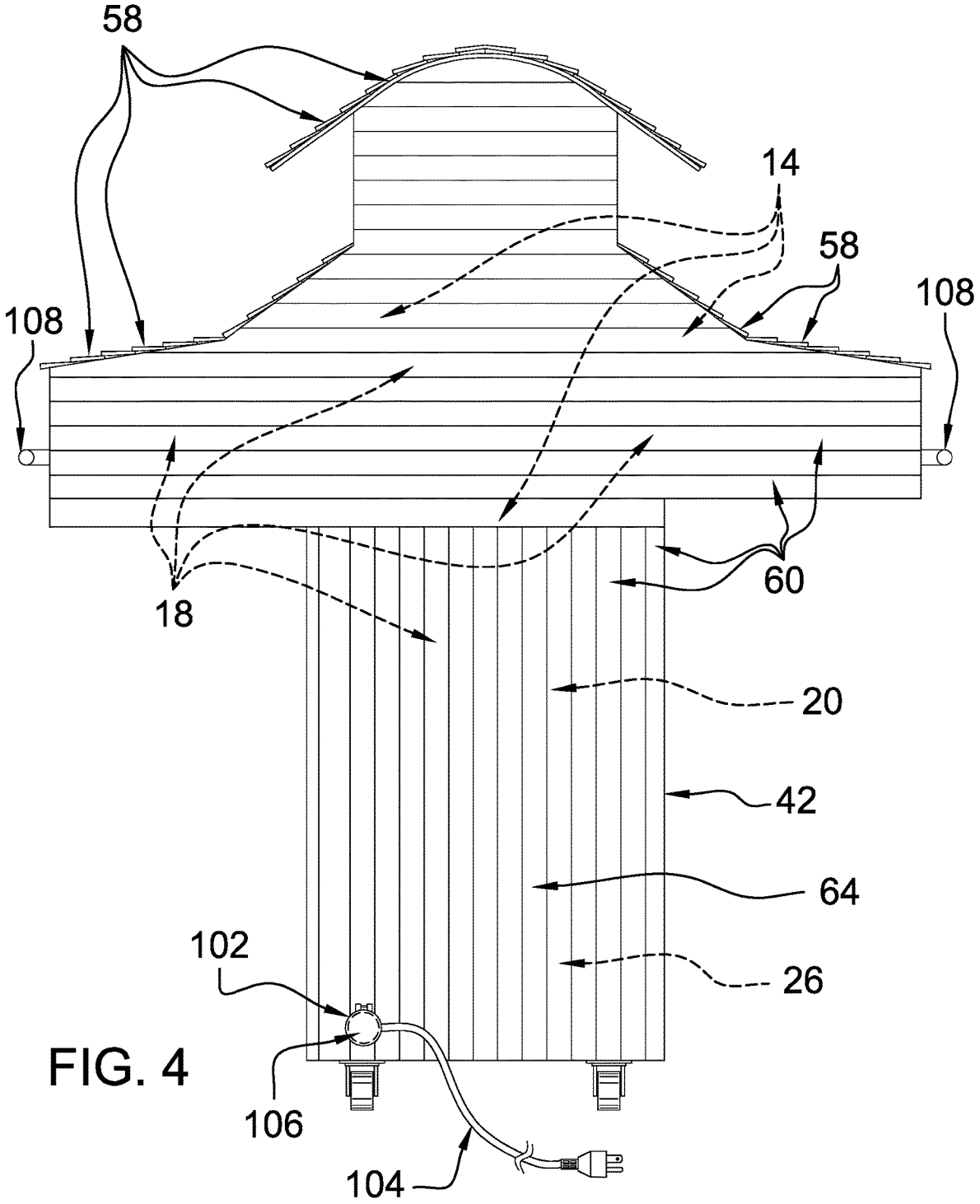
FIG. 4 is a rear view of an embodiment of the disclosure.
Figure 5:
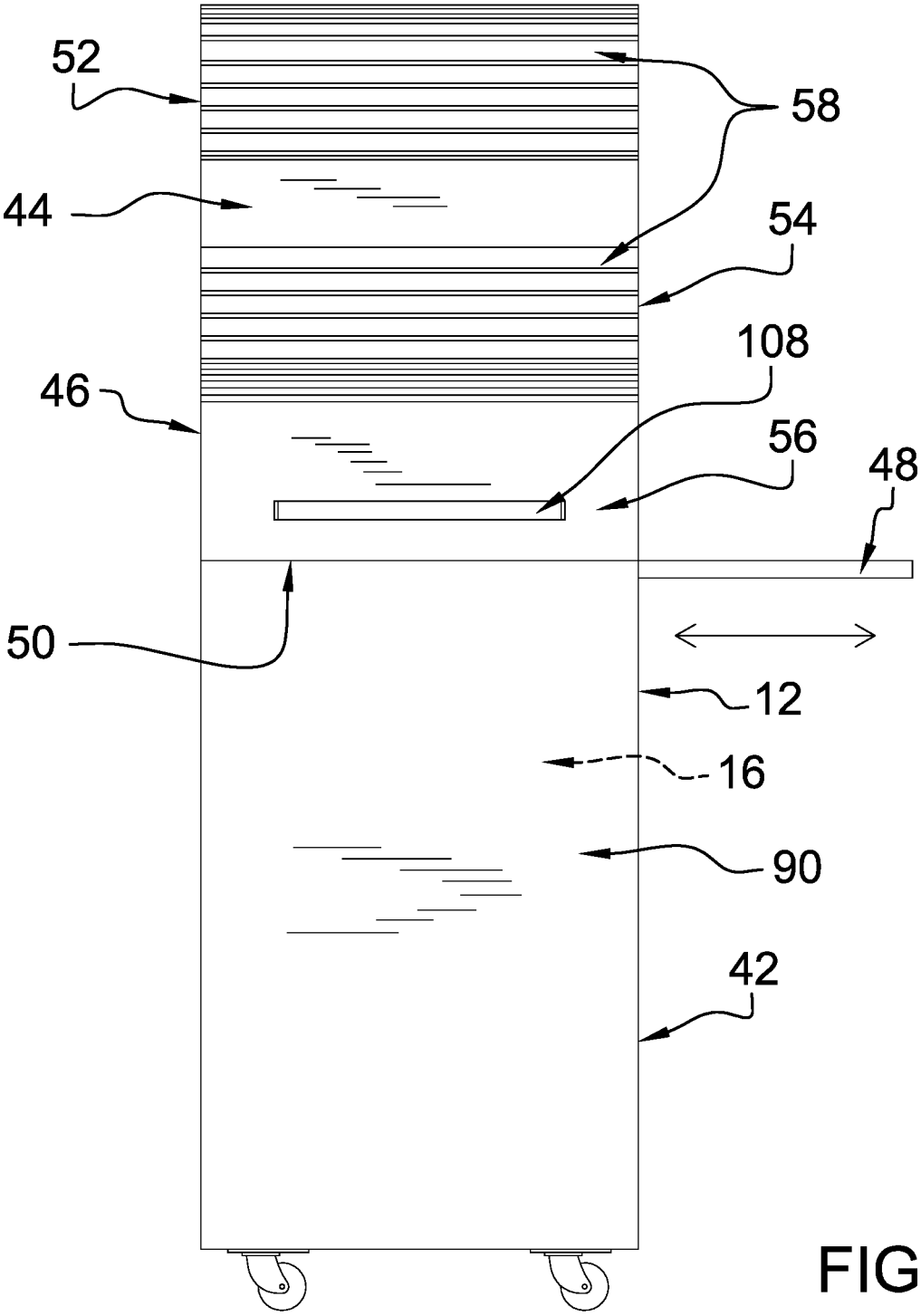
FIG. 5 is a left side view of an embodiment of the disclosure.

A shelf 48 is engaged to a lower facet 50 of a respective third section 46. The shelf 48 is selectively extensible from the respective third section 46, as shown in FIG. 2, and is configured for the positioning of articles.

An upper roofing panel 52 is engaged to the second section 44 of the housing 12. The upper roofing panel 52 is arcuate and thus is configured to shed water. Each third section 46 of the housing 12 has a lower roofing panel 54 engaged thereto. The lower roofing panel 54 extends transversely and downwardly from the second section 44 to an outer limit 56 of the third section 46 and thus is configured to shed water.

Each of the upper roofing panel 52 and the lower roofing panels 54 may comprise a plurality of roof slats 58. Additionally, a plurality of decorative slats 60 may be engaged to a front 62 and a rear 64 of the housing 12.

The housing 12 has positioned therein a first opening 66 and a second opening 68 to allow access to the first compartment 20 and the second compartment 22, respectively. The third compartments 24 also are accessed via the second opening 68. A first door 70 and a second door 72 are hingedly engaged to the housing 12 and are configured to selectively close the first opening 66 and the second opening 68, respectively. The light 36, which is positioned in the second compartment 22, may be configured for illumination upon opening of the second door 72.

A fastener 74 is engaged to the housing 12 and is configured to selectively engage the first door 70 to secure the first door 70 over the first opening 66. The fastener 74 may comprise a latch 76, or other door fastening means, such as, but not limited to, magnetic closures, flex-grip and roller catches, and the like. A doorknob 78 is engaged to the second door 72 and is configured to be grasped in a hand of a user to hinge the second door 72.

The first door 70 may comprise grating 80 and a lower panel 82, with the lower panel 82 being substantially transparent. The lower panel 82 is configured to substantially seal the first opening 66 while allowing contents of the first compartment 20 to be visible. The second door 72 may comprise a pair of upper panels 84 and a plurality of cork slices 86. The upper panels 84 are substantially transparent with the cork slices 86 being sandwiched therebetween.

Figure 6:
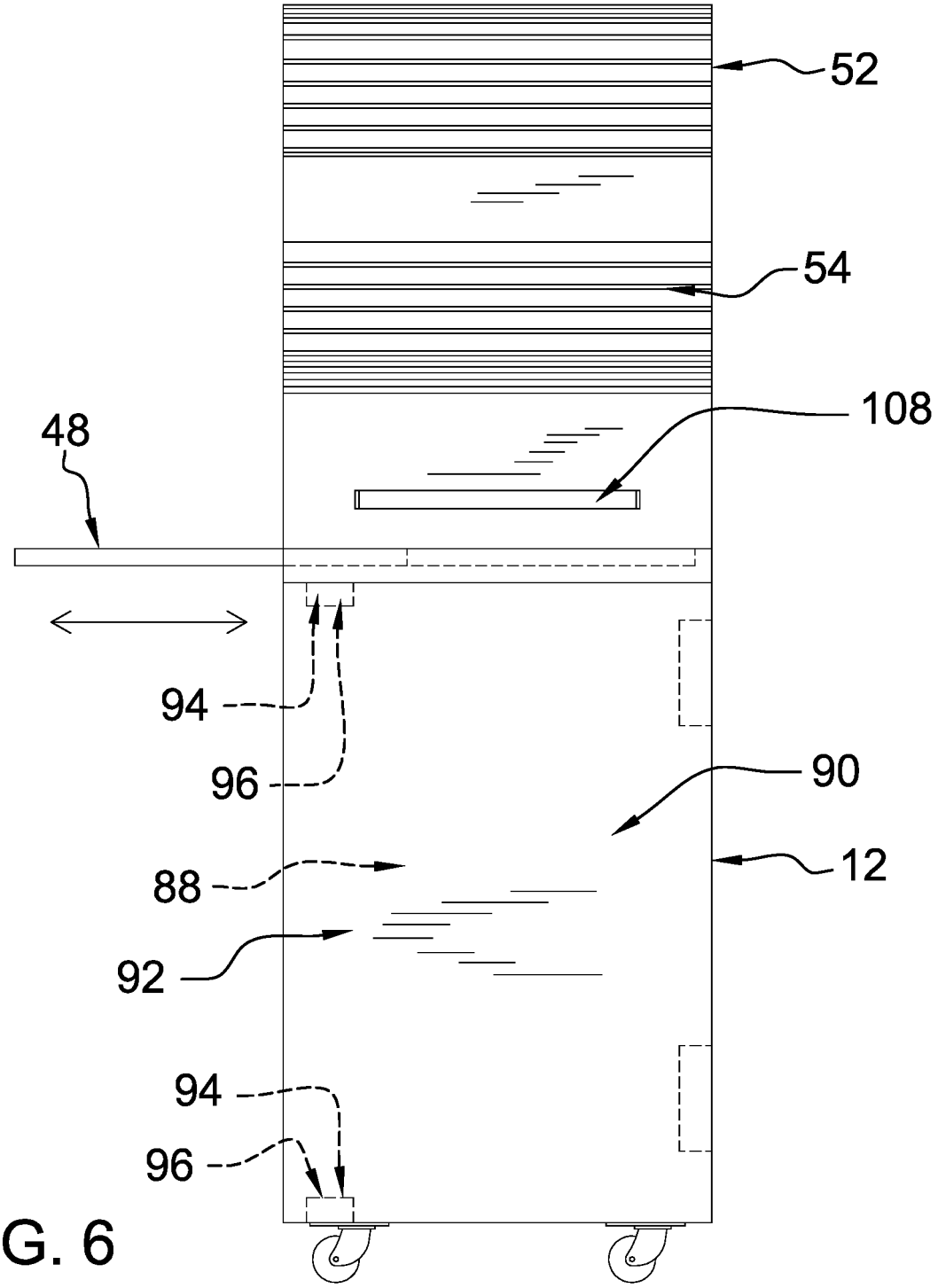
FIG. 6 is a right side view of an embodiment of the disclosure.
Figure 7:
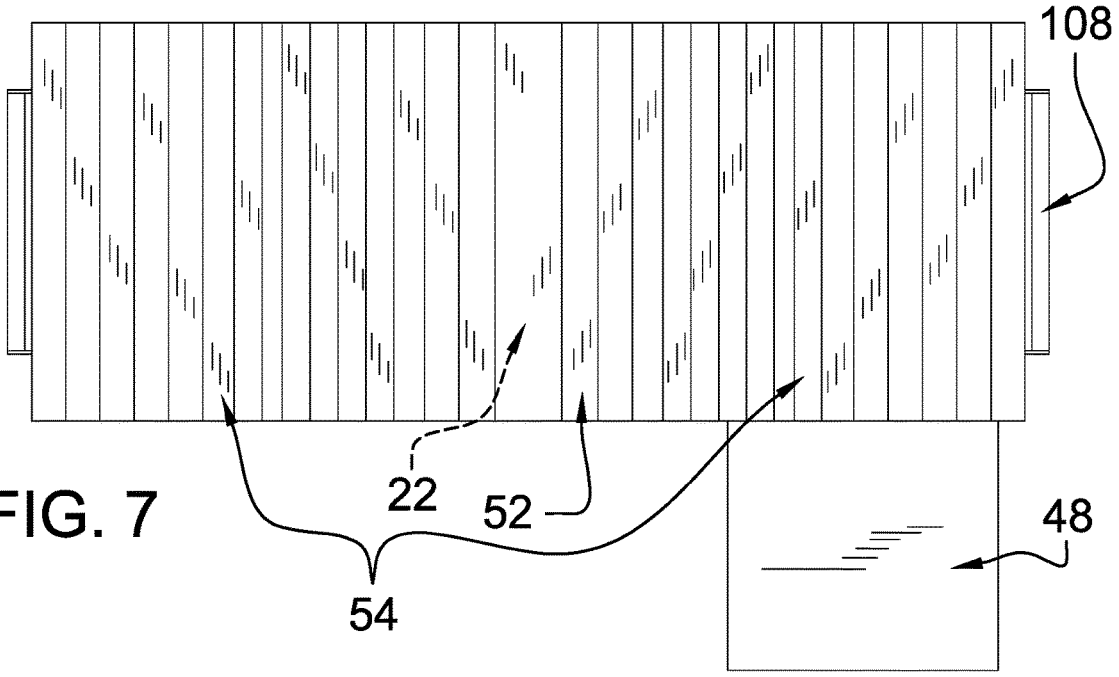
FIG. 7 is a top view of an embodiment of the disclosure.
Figure 8:
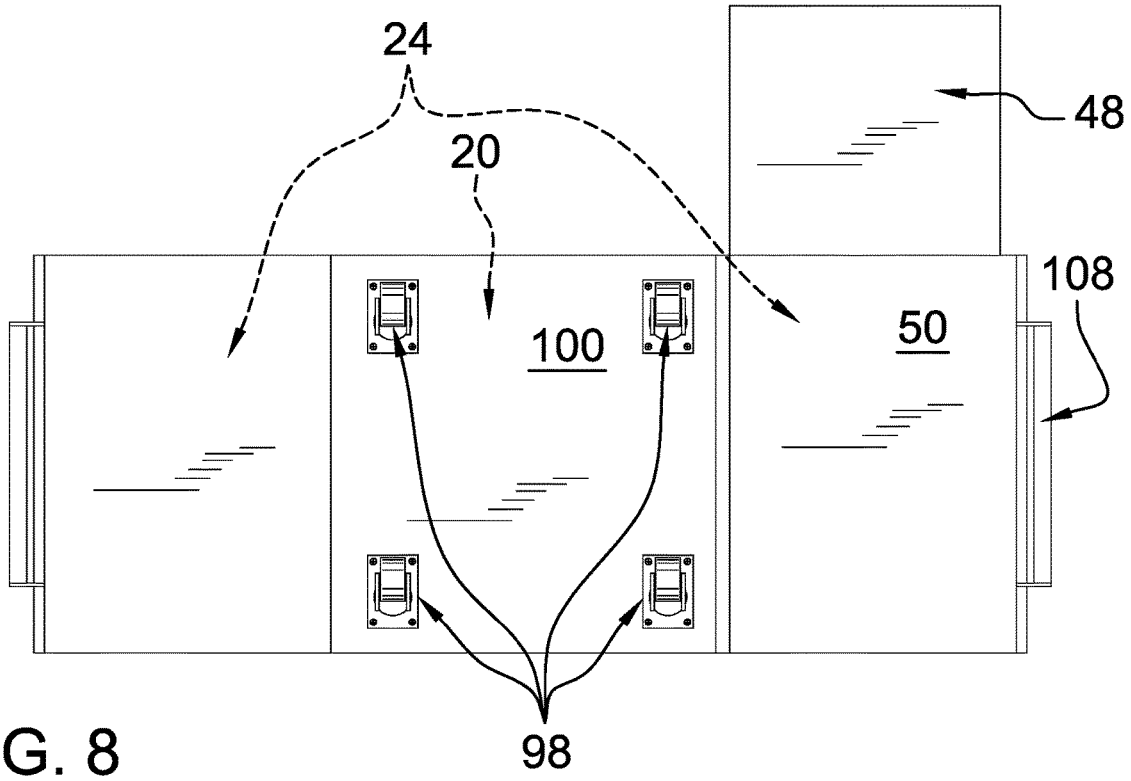
FIG. 8 is a bottom view of an embodiment of the disclosure.

The housing 12 may have a third opening 88 positioned in a respective opposed side 90 thereof. The third opening 88 is configured to allow alternative access to the first compartment 20. A third door 92 is hingedly engaged to the housing 12 and is configured to selectively close the third opening 88. The third door 92 may be internally hinged, as shown in FIG. 6. A catch 94 is engaged to the third door 92 and is configured to selectively engage the housing 12 to secure the third door 92 over the third opening 88. The catch 94 may comprise a magnet 96, or other catching means, such as, but not limited to, latches, flex-grip and roller catches, and the like.

A plurality of castors 98 is engaged to a lower face 100 of the housing 12. The castors 98 are configured to allow locomotion of the housing 12 upon a substantially horizontal surface.

The housing 12 has a hole 102 positioned in the rear 64 thereof. The hole 102 is configured for extension therethrough of a power cord 104 of the refrigerator 26, which is positioned in the first compartment 20. A covering 106 is engaged to the housing 12 and is configured to selectively close the hole 102 when not in use.

A handle 108 is engaged to the housing 12 and is configured to be grasped in the hand of the user. The handle 108 is configured to be grasped in the hand of the user, enabling the user to locomote the housing 12 upon the castors 98.

In use, the housing 12 is positioned in a location desired by the user, such as on a patio. The refrigerator 26 or the wine rack 28 can be positioned in the first compartment 20 and stocked with wine. Wine glasses and utensils can be stowed in the second compartment 22 and drawers 38, respectively.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A storage cabinet assembly comprising:

a housing defining an interior space;

a plurality of divider panels engaged to the housing and positioned in the interior space defining a plurality of compartments, the plurality of compartments comprising:

a first compartment configured for positioning one of a refrigerator and a wine rack, a second compartment positioned above the first compartment, the second compartment having a plurality of upper slats positioned therein, the upper slats being engaged to an upper limit of the second compartment defining a plurality of slots, wherein the slots are configured for insertion of bases of stemware for stowing stemware within the second compartment, and a third compartment opening into the second compartment and being configured for stowing utensils;

the housing having positioned therein a first opening and a second opening for accessing the first compartment and the second compartment, respectively;

a first door and a second door hingedly engaged to the housing and being configured for selectively closing the first opening and the second opening, respectively;

the first door comprising grating and a lower panel, the lower panel being substantially transparent, wherein the lower panel is configured for substantially sealing the first opening while allowing contents of the first compartment to be visible; and the second door comprising a pair of upper panels and a plurality of cork slices, the upper panels being substantially transparent with the cork slices being sandwiched therebetween.

2. The storage cabinet assembly of claim 1, wherein the third compartment is one of a pair of third compartments bracketing the second compartment.

3. The storage cabinet assembly of claim 2, wherein the housing comprises a first section containing the first compartment, a second section containing the second compartment, and a pair of third sections containing the third compartments, the first section and the second section being substantially rectangularly box shaped, the second section being engaged to and positioned above the first section, the third sections bracketing the second section.

4. The storage cabinet assembly of claim 3, further including a shelf engaged to a lower facet of a respective third section, the shelf being selectively extensible from the respective third section, wherein the shelf is configured for positioning articles.

5. The storage cabinet assembly of claim 1, further including a fastener engaged to the housing and being configured for selectively engaging the first door for securing the first door over the first opening.

6. The storage cabinet assembly of claim 5, further including the fastener comprising a latch.

7. The storage cabinet assembly of claim 1, further including a light engaged to one of the housing and a respective divider panel, the light being positioned in and configured for selectively illuminating the second compartment.

8. The storage cabinet assembly of claim 7, wherein the light is configured for illumination upon opening of the second door.

9. The storage cabinet assembly of claim 1, further including:

the housing having a third opening positioned in a respective opposed side thereof, wherein the third opening is configured for accessing the first compartment;

a third door hingedly engaged to the housing and being configured for selectively closing the third opening, the third door being internally hinged; and a catch engaged to the third door and being configured for selectively engaging the housing for securing the third door over the third opening.

10. The storage cabinet assembly of claim 9, wherein the catch comprises a magnet.

11. The storage cabinet assembly of claim 1, further including a doorknob engaged to the second door, wherein the doorknob is configured for grasping in a hand of a user for hinging the second door.

12. The storage cabinet assembly of claim 1, further including:

a drawer positioned in and selectively slidable from the third compartment into the second compartment, wherein the drawer is configured for stowing utensils and wherein the utensils are accessible to a user when the drawer is pulled from the third compartment into the second compartment; and a drawer knob engaged to the drawer, wherein the drawer knob is configured for grasping in a hand of a user for drawing the drawer into the third compartment.

13. The storage cabinet assembly of claim 1, further including a plurality of castors engaged to a lower face of the housing, wherein the castors are configured for locomoting the housing upon a substantially horizontal surface.

14. The storage cabinet assembly of claim 1, further including:

the housing having a hole positioned in a rear thereof, wherein the hole is configured for extending therethrough a power cord of a refrigerator positioned in the first compartment; and a covering engaged to the housing and being configured for selectively closing the hole.

15. The storage cabinet assembly of claim 1, further including a handle engaged to the housing and being configured for grasping in a hand of a user, wherein the handle is configured for grasping in the hand of the user, enabling the user for locomoting the housing upon the castors.

16. A storage cabinet assembly comprising:

a housing defining an interior space;

a plurality of divider panels engaged to the housing and positioned in the interior space defining a plurality of compartments, the plurality of compartments comprising:

a first compartment configured for positioning one of a refrigerator and a wine rack, a second compartment positioned above the first compartment, the second compartment having a plurality of upper slats positioned therein, the upper slats being engaged to an upper limit of the second compartment defining a plurality of slots, wherein the slots are configured for insertion of bases of stemware for stowing stemware within the second compartment, and a third compartment opening into the second compartment and being configured for stowing utensils;

the housing having positioned therein a first opening and a second opening for accessing the first compartment and the second compartment, respectively;

a first door and a second door hingedly engaged to the housing and being configured for selectively closing the first opening and the second opening, respectively;

wherein the third compartment is one of a pair of third compartments bracketing the second compartment;

wherein the housing comprises a first section containing the first compartment, a second section containing the second compartment, and a pair of third sections containing the third compartments, the first section and the second section being substantially rectangularly box shaped, the second section being engaged to and positioned above the first section, the third sections bracketing the second section;

an upper roofing panel engaged to the second section of the housing, the upper roofing panel being arcuate wherein the upper roofing panel is configured for shedding water; and each third section of the housing having a lower roofing panel engaged thereto, the lower roofing panel extending transversely and downwardly from the second section to an outer limit of the third section of the housing, wherein the lower roofing panel is configured for shedding water.

17. The storage cabinet assembly of claim 16, further including:

each of the upper roofing panel and the lower roofing panels comprising a plurality of roof slats; and a plurality of decorative slats engaged to a front and a rear of the housing.

18. A storage cabinet assembly comprising:

a housing defining an interior space;

a plurality of divider panels engaged to the housing and positioned in the interior space defining a plurality of compartments, the plurality of compartments comprising:

a first compartment configured for positioning one of a refrigerator and a wine rack, a second compartment positioned above the first compartment, the second compartment having a plurality of upper slats positioned therein, the upper slats being engaged to an upper limit of the second compartment defining a plurality of slots, wherein the slots are configured for insertion of bases of stemware for stowing stemware within the second compartment, and a third compartment opening into the second compartment and being configured for stowing utensils, the third compartment being one of a pair of third compartments bracketing the second compartment;

the housing comprising a first section containing the first compartment, a second section containing the second compartment, and a pair of third sections containing the third compartments, the first section and the second section being substantially rectangularly box shaped, the second section being engaged to and positioned above the first section, the third sections bracketing the second section;

a shelf engaged to a lower facet of a respective third section, the shelf being selectively extensible from the respective third section, wherein the shelf is configured for positioning articles;

an upper roofing panel engaged to the second section of the housing, the upper roofing panel being arcuate wherein the upper roofing panel is configured for shedding water;

each third section of the housing having a lower roofing panel engaged thereto, the lower roofing panel extending transversely and downwardly from the second section to an outer limit of the third section of the housing, wherein the lower roofing panel is configured for shedding water;

the housing having positioned therein a first opening and a second opening for accessing the first compartment and the second compartment, respectively, the housing having a third opening positioned in a respective opposed side thereof, wherein the third opening is configured for accessing the first compartment;

a first door hingedly engaged to the housing and being configured for selectively closing the first opening;

a fastener engaged to the housing and being configured for selectively engaging the first door for securing the first door over the first opening, the fastener comprising a latch;

a second door hingedly engaged to the housing and being configured for selectively closing the second opening;

a light engaged to one of the housing and a respective divider panel, the light being positioned in and configured for selectively illuminating the second compartment, the light being configured for illumination upon opening of the second door;

a third door hingedly engaged to the housing and being configured for selectively closing the third opening, the third door being internally hinged;

a catch engaged to the third door and being configured for selectively engaging the housing for securing the third door over the third opening, the catch comprising a magnet;

a doorknob engaged to the second door, wherein the doorknob is configured for grasping in a hand of a user for hinging the second door;

a drawer positioned in and selectively slidable from the third compartment into the second compartment, wherein the drawer is configured for stowing utensils and wherein the utensils are accessible to the user when the drawer is pulled from the third compartment into the second compartment;

a drawer knob engaged to the drawer, wherein the drawer knob is configured for grasping in the hand of the user for drawing the drawer into the third compartment;

a plurality of castors engaged to a lower face of the housing, wherein the castors are configured for locomoting the housing upon a substantially horizontal surface;

the housing having a hole positioned in a rear thereof, wherein the hole is configured for extending therethrough a power cord of a refrigerator positioned in the first compartment;

a covering engaged to the housing and being configured for selectively closing the hole; and a handle engaged to the housing and being configured for grasping in the hand of the user, wherein the handle is configured for grasping in the hand of the user, enabling the user for locomoting the housing upon the castors.

19. The storage cabinet assembly of claim 18, further including:

each of the upper roofing panel and the lower roofing panels comprising a plurality of roof slats;

a plurality of decorative slats engaged to a front and the rear of the housing;

the first door comprising grating and a lower panel, the lower panel being substantially transparent, wherein the lower panel is configured for substantially sealing the first opening while allowing contents of the first compartment to be visible; and the second door comprising a pair of upper panels and a plurality of cork slices, the upper panels being substantially transparent with the cork slices being sandwiched therebetween.

* * * * *